US007926183B2

(12) United States Patent
Groh

(10) Patent No.: US 7,926,183 B2
(45) Date of Patent: Apr. 19, 2011

(54) HAIR CUTTING COMB WITH REMOVABLE BLADE

(76) Inventor: Andrew Groh, Montvale, NJ (US)

( * ) Notice: Subject to any disclaimer, the term of this patent is extended or adjusted under 35 U.S.C. 154(b) by 377 days.

(21) Appl. No.: 11/975,427

(22) Filed: Oct. 19, 2007

(65) Prior Publication Data

US 2008/0235951 A1 Oct. 2, 2008

Related U.S. Application Data

(60) Provisional application No. 60/920,426, filed on Mar. 27, 2007.

(51) Int. Cl.
*B26B 21/12* (2006.01)
*B26B 21/08* (2006.01)

(52) U.S. Cl. ..... 30/30; 30/50; 30/53; 30/335

(58) Field of Classification Search ..... 30/30, 31, 30/53–55, 66, 67, 330, 335, 50, 81; 132/148, 132/213, 213.5, 215, 213.1; D28/25
See application file for complete search history.

(56) References Cited

U.S. PATENT DOCUMENTS

| | | | | | |
|---|---|---|---|---|---|
| 2,141,340 | A | * | 12/1938 | Baumgarten | 30/30 |
| 2,650,421 | A | * | 9/1953 | Wietzel | 30/30 |
| 2,650,451 | A | * | 9/1953 | Karstedt | 43/131 |
| 2,972,187 | A | * | 2/1961 | Gore | 30/30 |
| 3,855,696 | A | * | 12/1974 | Spanel | 30/30 |
| 4,058,891 | A | * | 11/1977 | Spanel | 30/30 |
| 5,330,492 | A | * | 7/1994 | Haugen | 606/167 |
| D364,939 | S | | 12/1995 | Scott | |
| 6,094,820 | A | * | 8/2000 | Adachi | 30/30 |
| 6,701,619 | B2 | * | 3/2004 | Haruyuki | 30/47 |
| 2009/0032043 | A1 | * | 2/2009 | Gaugler | 132/148 |

* cited by examiner

*Primary Examiner* — Laura M. Lee
(74) *Attorney, Agent, or Firm* — Kenyon & Kenyon, LLP

(57) ABSTRACT

A hair cutting comb may include a comb body with a cutting section, a cavity in the cutting section for slidably receiving a razorblade, and a longitudinal opening connected to the cavity, where a side portion of the razorblade is exposed by the longitudinal opening. The hair cutting comb may have a retaining clip that, when in a closed position, retains the razorblade in the cavity.

13 Claims, 3 Drawing Sheets

SECTION A-A

HAIR CUTTING COMB WITH REMOVABLE BLADE

RELATED APPLICATION INFORMATION

The present application claims the benefit of U.S. Provisional Application Ser. No. 60/920,426 filed on Mar. 27, 2007, which is expressly incorporated herein by reference in its entirety.

BACKGROUND

The present invention relates generally to a hair cutting comb and more specifically to a hair cutting comb with removable blades.

Existing hair cutting combs are known, such as for example, Design Pat. No. D364,939. These combs include a razor between the teeth so that a user may both comb and trim a person's hair. This combination includes the protection of a retracted blade disposed internal to the teeth of the comb. To replace the blades, a user must remove a top clip portion and push a tab that forces the blades up through a center chamber or cavity. This technique is not only very difficult to manually accomplish, but it is common for the tab and or comb to break when attempting to replace the blade.

Another problem with existing combs is the usage of a top clip portion to hold the blades in place. This top clip portion snaps into place on the top of the comb and prevents the razor blades from falling out. This piece can easily break or get lost. Without this piece, the comb itself is essentially rendered useless for its intended purpose because the blades don't stay in place. Thus, if this simple little piece breaks or is lost, the comb cannot be used.

DETAILED DESCRIPTION OF THE EXAMPLE EMBODIMENTS

According to some example embodiments of the present invention, a hair cutting comb may have a body which has a cutting section, a cavity in the cutting section configured to slidably and removably receive a razorblade along an axis parallel to a cutting edge of the razorblade through a lateral top opening of the comb body, and a longitudinal opening in communication with the cavity. A side portion of the razorblade may be exposed by the longitudinal opening when the razorblade is received in the body. A retaining clip, which may be T-shaped, retains the razorblade in the cavity when the retaining clip is in a closed position and when the razorblade is slidably received in the cavity. In some examples, the retaining clip may entirely cover the longitudinal opening. The retaining clip may slide along a track disposed in the body. In some of these examples, the track is disposed along the longitudinal opening. The retaining clip may be secured by a latch, which, according to some examples, may have a detent. The retaining clips may have a grip enhancing section, which may be textured. The grip enhancing section may have at least one lateral ridge and, in some examples, a plurality of lateral ridges. According to some examples, the cavity may slidably and removably receive two oppositely oriented razorblades. The two oppositely oriented razorblades may partially overlap. The entire length of the razor blade may be exposed along the longitudinal opening when the retaining clip is in an open position. In some examples, the retaining clip may be removable from the body.

Figure 1:
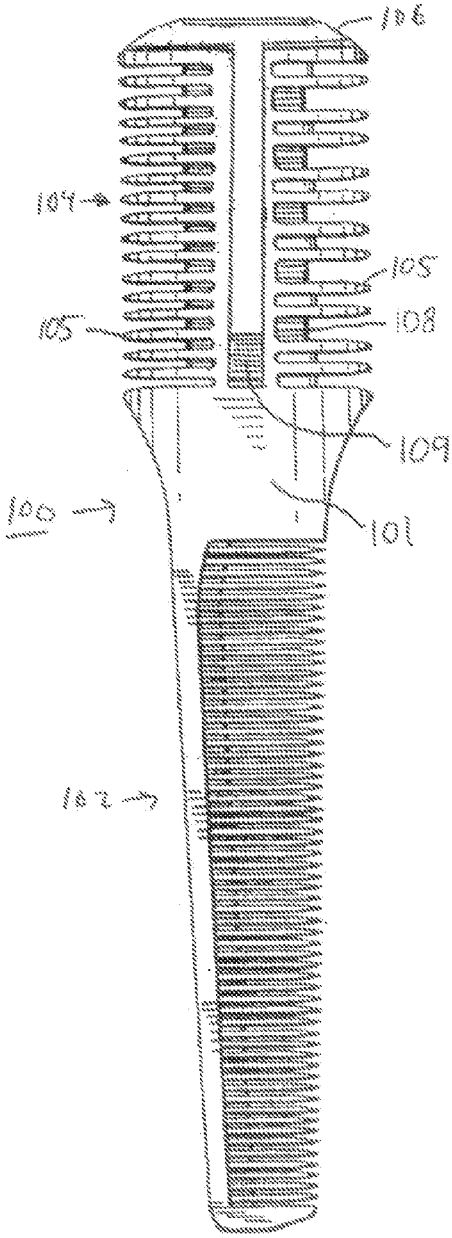
FIG. 1 depicts a front view of an example hair cutting comb with a retaining clip in a closed position according to an example embodiment of the present invention.

FIG. 1 depicts a front view of an example hair cutting comb 100 with a retaining clip 106 in a closed position according to an example embodiment of the present invention. The hair cutting comb 100 is made up of a comb body 101, a pair of oppositely oriented razorblades 108, and a retaining clip 106. The comb body 101 includes a straight comb section 102 and a cutting section 104. The retaining clip 106 retains the razorblades 108 which are slidably and removably received into a cavity in the cutting section 104 of the comb body 101. Although the retaining clip 106 depicted in FIG. 1 is T-shaped, it will be appreciated that, according to other example embodiments, the retaining clip may have any shape appropriate for retaining the razorblades, such as, e.g., an L-shape. It will be further appreciated that, according to other embodiments, that the cutting section may contain only one razorblade or more than two razorblades. According to some of these other embodiments, the razorblades may be stacked lengthwise, i.e., end-to-end, in the cavity. It will also be appreciated that, although the hair cutting comb depicted in FIG. 1 has single-edged razorblades, in other embodiments, the hair cutting comb may receive double-edged razorblades. As depicted in FIG. 1, the retaining clip 106 has a grip enhancing section 109, which may assist a user in sliding the retaining clip between the closed position and an open position, and vice-versa, by, for example, providing a surface having a high coefficient of friction to increase traction between the user's finger and the surface.

In the example embodiment of FIG. 1, the cutting edges of the razorblades are exposed through at least some of the gaps between the cutting section teeth 105. As indicated in FIG. 1, the cutting section 104 has differing patterns of cutting section teeth 105, where on the left side, the cutting section teeth 105 are evenly spaced and have an opening between each cutting section tooth 105, and on the right side, the cutting section teeth 105 have alternating spacing and openings disposed at alternating gaps between the cutting section teeth 105. This varied spacing allows the user to use the comb for different purposes such as cutting or trimming hair in different approaches. It will be appreciated, however, that other designs may be employed and that the cutting section teeth on the left side may be identically configured to the cutting section teeth on the right side. It will also be appreciated that the cutting section may only have cutting section teeth on only one side, with only one exposed razorblade cutting edge. Regardless of the teeth formation, it is important that the razorblades 108 stay securely fit within the cavity and locked in place for proper usage. It is also important to be able to readily remove and replace the razorblades without risking the usage or integrity of the comb, as continued usage is apt to dull the blades.

Figure 2:
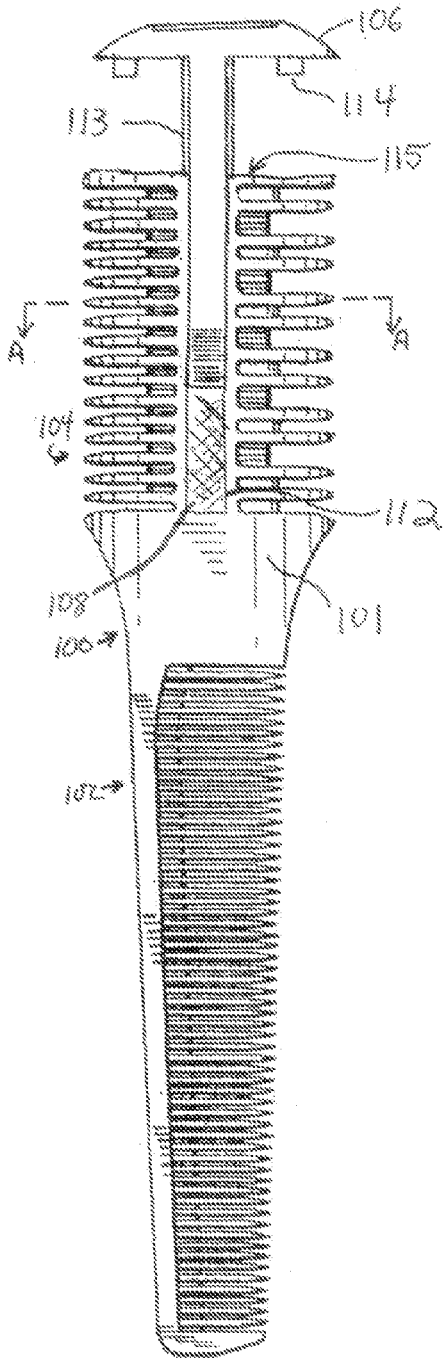
FIG. 2 depicts a front view of the example hair cutting comb with the retaining clip in a partially open position, according to the example embodiment of the present invention.

FIG. 2 depicts a front view of the example hair cutting comb 100 with the retaining clip 106 in a partially open position, according to the example embodiment of the present invention. The retaining clip 106 has been raised by sliding along a track (not shown in FIG. 2) disposed along a longitudinal opening 112. Ribs 113 along the edge of the retaining clip 113 ride within and slide along the track. As the retaining clip 106 is slid in an upward direction, a portion of the razorblade 108 is exposed by the longitudinal opening 112. In the embodiment depicted in FIG. 2, the clip may be slid entirely out of the cutting section 104 and thus entirely removed from the comb body 101—in this embodiment, the retaining clip 106 is in an open position when it is entirely removed. It will be appreciated, however, that according to other embodiments, the retaining clip may remain attached when in an open position, e.g., by a tether, by having the sliding limited to a certain distance of travel, and/or a hinge. The retaining clip 106 has a pair of tabs 114 that serve to latch the retaining clip 106 into the closed position by communicating with an opening in the cutting section 104. The tabs 114 latch by way of detents. It will be appreciated, however, that any latching method may be employed, such as, e.g., a tight or "friction" fit, and may or may not include tabs. When the retaining clip depicted in FIG. 2 is in an open position, the entire length of the razorblade 108 is exposed through the longitudinal opening 112. In other embodiments, only a portion of the length may be exposed when the retaining clip is in the open position.

Although the retaining clip 106 depicted in FIG. 2 slides in a track in the cutting section 104 and is secured by tabs 114, it will be appreciated that other methods of securing the retaining clip to the comb body 101 and/or moving the retaining clip 106 to and from a closed position may be employed, such as, e.g., a hinge between the lower end of the retaining clip and the comb body and a latch between the upper end of the retaining clip and the comb body.

When the retaining clip is in an open position, the razorblade may be inserted or removed through a lateral top opening 115 of the comb body by pressing upwardly on the portion of the side of the razorblade that is exposed through the longitudinal opening 112. Because the razorblades are wider than the longitudinal opening 112, they are constrained in all directions other than sliding along the direction of the longitudinal opening 112.

Figure 3:
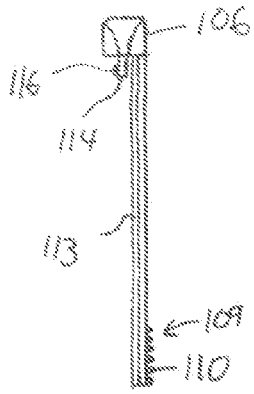
FIG. 3 depicts a left side view of the retaining clip of the example hair cutting, according to the example embodiment of the present invention.

FIG. 3 depicts a left side view of the retaining clip of the example hair cutting comb, according to the example embodiment of the present invention. The retaining clip is depicted in the open position—i.e., removed from the comb body 101. The tabs 114 of the retaining clip 106 have detents 116 that engage the comb body in a detent relationship when the retaining clip 106 is in the closed position. The grip enhancing section 109 includes a plurality of lateral ridges 110. Although the grip enhancing section 109 depicted in FIG. 3 has lateral ridges 110 that are linear and parallel, it will be appreciated that other embodiments may employ different designs, such as, e.g., wavy ridges, non-parallel ridges, intersecting ridges, knurling, a concave geometry, and/or any other configuration suitable for facilitate the sliding of the retaining clip. As depicted in FIG. 3, the ribs 113 do not extend as far as the front face of the retaining clip 109. In the depicted embodiment, the retaining clip 106 is dimensioned so that its front face forms a substantially continuous surface with the front face of the comb body when the retaining clip 106 is in an closed position. The top portion of the retaining clip 106 extends in a rearward direction in order to close off the lateral top opening 115 of the comb body 101 when the retaining clip 106 is in a closed position, forming a positive stop for the razorblades 108, thus preventing the razorblades 108 from sliding out of the comb body 101 through the lateral top opening.

Figure 4:
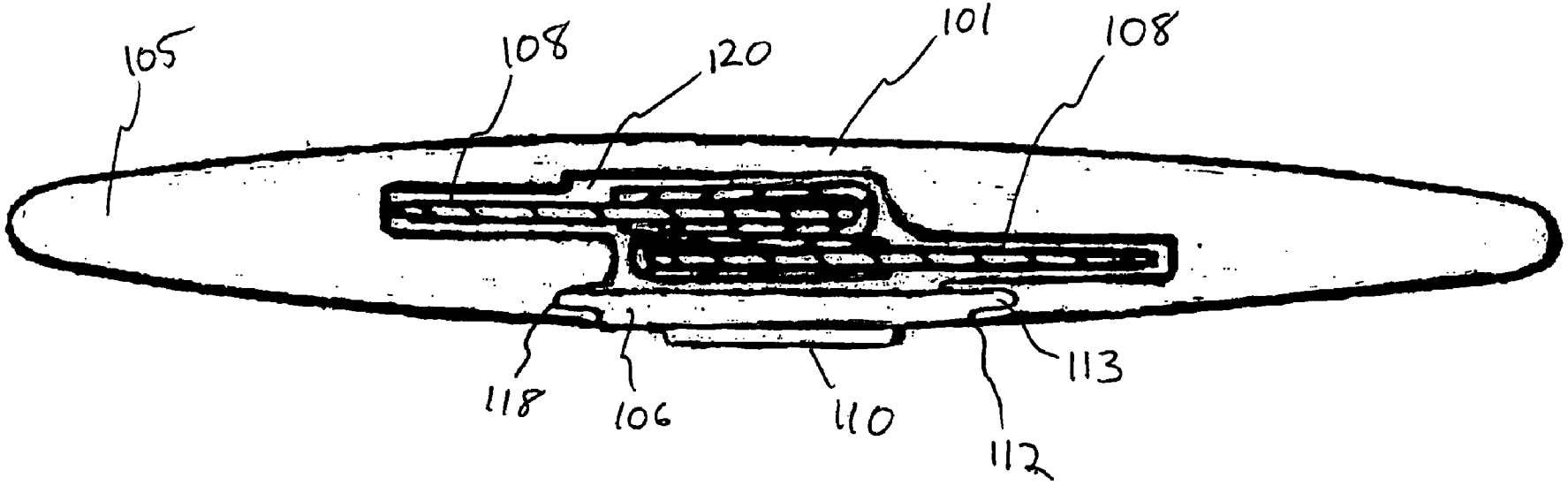
FIG. 4 depicts a cross-sectional view of the example hair cutting comb, along line A-A of FIG. 2, according to the example embodiment of the present invention.

FIG. 4 depicts a cross-sectional view of the example hair cutting comb, along line A-A of FIG. 2, according to the example embodiment of the present invention. The razorblades 108 are fixed within the casing and partially into the cutting section teeth 105, thereby securely and safely allowing a user to use the hair cutting comb in its normal operation. There are two single-sided razorblades contained in the cavity 120 of the comb body 101 and overlapping at the non-cutting regions of the razorblades. When the retaining clip 106 is slid along the track 118 in the comb body 101, the non-cutting region of first one of the razorblades is exposed along the longitudinal opening 112. As such, the first one of the razorblades 108 may be slid along the longitudinal opening 112, which then exposes the non-cutting region of the second one of the razorblades 108, which may then be removed in the same manner as the first one of the razorblades 108.

Figure 5:
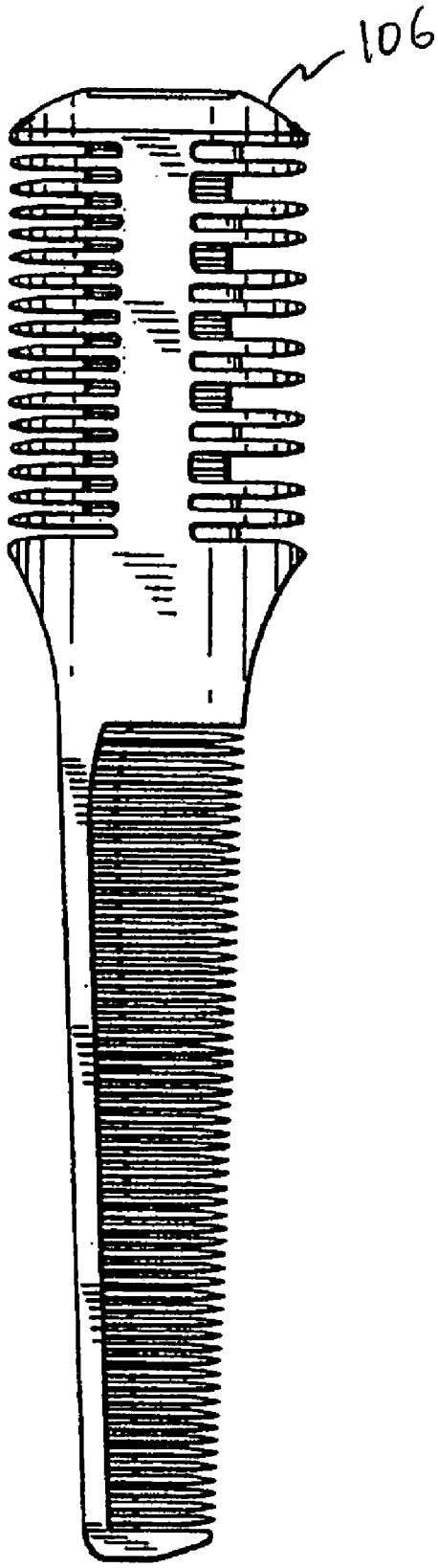
FIG. 5 depicts a rear view of the example hair cutting comb with the retaining clip in the closed position, according to the example embodiment of the present invention.

FIG. 5 depicts a rear view of the example hair cutting comb with the retaining clip in the closed position, according to the example embodiment of the present invention.

Thereby, the present invention improves over existing hair cutting combs by providing an improved razor blade securement and removal system. The t-element overcomes the limitations of a hard-to-move element and the problems with breaking that could occur at the top end of the comb.

It is recognized that additional embodiments may be realized based on various factors, including the shape of the comb itself. The present invention provides for the securing of the blades and the subsequent ease of removal through the utilization of the removable retaining clip 106. The portions of the comb itself may be adjusted, such as the bottom portion (e.g. portion 102 of FIG. 1) being a pick or other type of hair styling instrument. It is also recognized that different teeth spacing arrangements can be envisioned, such as teeth closer together, farther apart, spacing that increases in closeness, etc. These different embodiments still include the t-element 106 and the ability to slidably remove the t-element 106 and thus quickly and effectively remove and replace the razor blades. The removable t-element 106 also overcomes the common problem with existing combs with the removal, breakage and/or losing of the existing clipping element that holds the blades in place.

Several embodiments of the present invention are specifically illustrated and described herein. However, it will be appreciated that modifications and variations of the present invention are covered by the above teachings and within the purview of the appended claims without departing from the spirit and intended scope of the invention.

What is claimed is:

1. A hair cutting comb comprising:

a first razorblade having a cutting edge and a back portion opposite the cutting edge;

a second razorblade having a cutting edge and a back portion opposite the cutting edge;

a comb body having a cutting section, a cavity in the cutting section configured to slidably and removably receive the first razorblade and the second razorblade along an axis parallel to the cutting edge of the first razorblade and the cutting edge of the second razorblade through a laterally extending top opening of the comb body, a first plurality of teeth each extending transversely with respect to the length of the comb body in a first direction to a free end, the cutting edge of the first razorblade being externally exposed between the plurality of teeth when the first razorblade is received in the cavity, a second plurality of teeth each extending to a free end in a second direction opposite the first direction, the cutting edge of the second razorblade being externally exposed between the plurality of teeth when the second razorblade is received in the cavity, and a side opening in the comb body, the side opening extending longitudinally a distance along the length of the comb body and being in communication with the cavity, a side portion of the first razorblade being laterally exposed by the side opening when the first razorblade is received in the comb body to allow the first razorblade to be removed from the cavity by pressing the laterally exposed side portion of the first razorblade upwardly; and a T-shaped retaining clip having an elongated lower portion and an upper portion extending transversely with respect to the elongated lower portion, the retaining clip being slidable along the longitudinal extension of the side opening between an open position and a closed position, the upper portion having a first extension that is perpendicular to the elongated lower portion, and a second extension that is perpendicular to the elongated lower portion, wherein, when the retaining clip is in the closed position, the elongated lower portion extends along the side opening of the comb body, and the upper portion retains the first and second razorblades in the cavity by covering the laterally extending top opening when the first and second razorblades are slidably received in the cavity, wherein the first extension extends along its length in the first direction away from the longitudinal extension and toward the free ends of the first plurality of teeth, and the second extension extends along its length in the second direction away from the longitudinal extension and toward the free ends of the second plurality of teeth.

2. The hair cutting comb of claim 1, wherein the retaining clip is configured to entirely cover the side opening.

3. The hair cutting comb of claim 1, wherein the retaining clip is configured to slide along a track disposed in the body.

4. The hair cutting comb of claim 3, wherein the track is disposed along the longitudinal extension of the side opening.

5. The hair cutting comb of claim 3, wherein the retaining clip is configured to be secured by a latch.

6. The hair cutting comb of claim 5, wherein the latch comprises a detent.

7. The hair cutting comb of claim 3, wherein the retaining clip has a grip enhancing section.

8. The hair cutting comb of claim 7, wherein the grip enhancing section is textured.

9. The hair cutting comb of claim 7, wherein the grip enhancing section comprises a lateral ridge.

10. The hair cutting comb of claim 9, wherein the grip enhancing section comprises a plurality of lateral ridges.

11. The hair cutting comb of claim 1, wherein the back portion of the first razorblade overlaps the back portion of the second razorblade.

12. The hair cutting comb of claim 1, wherein the entire length of the razor blade is laterally exposed along the longitudinal extension of the side opening when the retaining clip is in the open position.

13. The hair cutting comb of claim 1, wherein the retaining clip is removable from the body.

* * * * *